US008206139B2

(12) United States Patent
Hirayama

(10) Patent No.: US 8,206,139 B2
(45) Date of Patent: Jun. 26, 2012

(54) ROTARY COMPRESSOR AND REFRIGERATION CYCLE EQUIPMENT

(75) Inventor: Takuya Hirayama, Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 231 days.

(21) Appl. No.: 12/712,875

(22) Filed: Feb. 25, 2010

(65) Prior Publication Data

US 2010/0147020 A1 Jun. 17, 2010

Related U.S. Application Data

(63) Continuation of application No. PCT/JP2008/065460, filed on Aug. 28, 2008.

(30) Foreign Application Priority Data

Aug. 28, 2007 (JP) ..... 2007-221615

(51) Int. Cl.
*F01C 21/10* (2006.01)
*F03C 2/00* (2006.01)
*F03C 4/00* (2006.01)

(52) U.S. Cl. ..... 418/150; 418/11; 418/60

(58) Field of Classification Search ..... 418/11, 418/60, 63, 29, 30, 150; 417/410.3
See application file for complete search history.

(56) References Cited

U.S. PATENT DOCUMENTS

| | | | | |
|---|---|---|---|---|
| 7,563,084 | B2 | 7/2009 | Kurita | |
| 7,607,902 | B2 | 10/2009 | Onoda | |
| 2002/0104571 | A1 | 8/2002 | Hess et al. | |
| 2006/0002809 | A1 | 1/2006 | Kawabe et al. | |
| 2006/0153723 | A1 * | 7/2006 | Kurita et al. | 418/60 |
| 2008/0112831 | A1 | 5/2008 | Ogasawara | |

FOREIGN PATENT DOCUMENTS

| | | | |
|---|---|---|---|
| CN | 1356476 | | 7/2003 |
| CN | 1456813 | | 11/2003 |
| DE | 68913045 | | 3/1994 |
| EP | 0428526 | | 2/1994 |
| EP | 1605167 | A1 | 12/2005 |
| EP | 1285188 | | 1/2007 |
| JP | 55-48887 | | 11/1980 |
| JP | 57-63986 | | 4/1982 |
| JP | 57-165866 | | 10/1982 |
| JP | 59-67619 | | 5/1984 |

(Continued)

OTHER PUBLICATIONS

International Preliminary Report on Patentability issued in PCT/JP2008/065460 on Apr. 8, 2010.

(Continued)

*Primary Examiner* — Theresa Trieu
(74) *Attorney, Agent, or Firm* — DLA Piper LLP (US)

(57) ABSTRACT

A rotary compressor, which contains a motor unit and compression mechanism in a sealed case, transmits the rotational power of the motor to the compression mechanism through a rotary shaft and crankshafts eccentrically provided in the rotary shaft, and compresses a refrigerant in the compression mechanism, wherein the rotary compressor is configured to have $H/(\phi Da \cdot E)=K$, and $K \leqq 0.065$, and the formula $0.35+0.07 \cdot K \cdot H \leqq L/\phi Db \leqq 0.45+0.07 \cdot K \cdot H$, assuming that the inside diameter of the cylinder forming the compression mechanism is $\phi Da$ [mm], the cylinder height is H [mm], the crankshaft eccentricity is E [mm], the crankshaft diameter is $\phi Db$ [mm], and the sliding lengths of the crankshaft and a roller fitted over the crank are set to L [mm].

2 Claims, 3 Drawing Sheets

FOREIGN PATENT DOCUMENTS

| | | | | |
|---|---|---|---|---|
| JP | 62-195689 | | | 12/1987 |
| JP | 63-12689 | | | 1/1988 |
| JP | 63-45084 | | | 3/1988 |
| JP | 63147983 | A | * | 6/1988 |
| JP | 64-0031273 | | | 2/1989 |
| JP | 03-019175 | | | 1/1991 |
| JP | 03-500080 | | | 1/1991 |
| JP | 5-47469 | | | 6/1993 |
| JP | 8-144976 | | | 6/1996 |
| JP | 9-79159 | | | 3/1997 |
| JP | 2000087888 | A | * | 3/2000 |
| JP | 2001-099083 | | | 4/2001 |
| JP | 2002-138978 | | | 5/2002 |
| JP | 2002-181210 | | | 6/2002 |
| JP | 2003-328972 | | | 11/2003 |
| JP | 2003-533659 | | | 11/2003 |
| JP | 2004-124834 | | | 4/2004 |
| JP | 2004-301114 | A | | 10/2004 |
| JP | 2006-37893 | | | 2/2006 |
| JP | 2008-14150 | | | 1/2008 |
| JP | 2008-144587 | | | 6/2008 |
| KR | 2002-0034883 | | | 5/2002 |
| WO | WO 89/012552 | | | 12/1989 |
| WO | WO 01/088422 | | | 11/2001 |
| WO | WO-2004/083642 | A1 | | 9/2004 |

OTHER PUBLICATIONS

International Preliminary Report on Patentability issued in PCT/JP2008/065461 on Apr. 8, 2010.
File History of U.S. Appl. No. 12/686,414 electronically captured from PAIR on Aug. 6, 2010.
File History of U.S. Appl. No. 12/712,780 electronically captured from PAIR on Aug. 6, 2010.
English Abstract of JP 2004-301114 published Oct. 28, 2004.
Machine translation of JP-2004-301114 A published Oct. 28, 2004.
English translation of WO-2004/083642 A1 published Sep. 30, 2004.
International Search Report of International Application No. PCT/JP2008/062831, mailed Oct. 14, 2008.
English language abstract of JP-2002-181210 published Jun. 26, 2002.
Machine English language translation of JP-2002-181210 published Jun. 26, 2002.
English language abstract of JP-03-019175 published Jan. 28, 1991.
Machine English language translation of JP-2003-533659 published Nov. 11, 2003.
English Abstract of EP 1285188 published Feb. 26, 2003.
International Search Report issued in PCT/JP2008/065461 dated Nov. 25, 2008.
English Language Abstract of JP 2003-328972 Published Nov. 19, 2003.
Machine English Language Translation of JP 2003-328972 Published Nov. 19, 2003.
English Language Abstract of JP 55-048887 Published Apr. 8, 1980.
English Language Abstract of JP 2002-138978 Published May 17, 2002.
Machine English Language Translation of JP 2002-138978 Published May 17, 2002.
English Abstract of JP 1-247786 published Oct. 3, 1989.
English Language Abstract of CN Publication CN 1356476 published Jul. 3, 2002.
International Preliminary Report on Patentability issued in PCT/JP2008/062831 on Feb. 18, 2010.
File History of US Patent 7,607,902 issued Oct. 27, 2009.
International Search report for PCT/JP2008/065460 issued Oct. 7, 2008.
English Language Abstract of JP 8-144976 published Jun. 4, 1996.
Machine English Language Translation of JP 8-144976 published Jun. 4, 1996.
English Language Abstract of JP 9-79159 published Mar. 25, 1997.
Machine English Language Translation of JP 9-79159 published Mar. 25, 1997.
English Language Abstract of JP 2008-14150 published Jan. 24, 2008.
Machine English Language Translation of JP 2008-14150 published Jan. 24, 2008.
English Language Abstract of JP 2006-037893 published Feb. 9, 2006.
Machine English Language Translation of JP 2006-037893 published Feb. 9, 2006.
Machine English Language Translation of JP 05-047469 published Jun. 25, 1993.
English Abstract of JP 2003-533659 published Nov. 11, 2003.
File History of U.S. Appl. No. 12/953,731 electronically captured from PAIR on May 12, 2011.
English Language Abstract of JP 2004-124834 published Apr. 22, 2004.
English Language Translation of JP 2004-124834 published Apr. 22, 2004.
International Search Report issued for PCT/JP2009/059719 on Jul. 7, 2009.
English Language Abstract of JP 2008-144587 published Jun. 26, 2008.
English Language Translation of JP 2008-144587 published Jun. 26, 2008.
English Language Abstract of JP 57-63986 published Apr. 16, 1982.
English Language Abstract of JP 63-45084 published Mar. 26, 1988.
English Language Abstract of JP 63-12689 published Jan. 12, 1988.
English Language Abstract of JP 59-67619 published May 8, 1984.
International Preliminary Report on Patentability and Written Opinion issued for PCT/JP2009/059719 on Jan. 20, 2011.
English Abstract of JP 64-031273 published Feb. 1, 1989.
English Abstract of JP 57-165866 published Oct. 13, 1982.
File History of U.S. Appl. No. 12/712,780 electronically captured from PAIR on Feb. 13, 2012.
File History of U.S. Appl. No. 12/712,780 electronicaily captured from PAIR on Dec. 7, 2011.
English Language Abstract of JP 2000-087888 published Mar. 28, 2000.
English Language Translation of JP 2000-087888 published Mar. 28, 2000.
English Language Abstract of JP 2001-099083 published on Apr. 10, 2001.
English Language Translation of JP 2001-099083 published on Apr. 10, 2001.

* cited by examiner

ROTARY COMPRESSOR AND REFRIGERATION CYCLE EQUIPMENT

CROSS REFERENCE TO RELATED APPLICATIONS

This is a Continuation Application of PCT Application No. PCT/JP2008/065460, filed Aug. 28, 2008, which was published under PCT Article 21(2) in Japanese.

This application is based upon and claims the benefit of priority from prior Japanese Patent Application No. 2007-221615, filed Aug. 28, 2007, the entire contents of which are incorporated herein by reference.

BACKGROUND OF THE INVENTION

1. Field of the Invention

The present invention relates to a rotary compressor to compress a refrigerant, and refrigeration cycle equipment such as an air conditioner and refrigerator using the rotary compressor.

2. Description of the Related Art

Large capacity has been demanded in a rotary compressor, which contains a motor unit and a compression mechanism in a sealed case, transmits the rotational power of the motor to the compression mechanism through a rotary shaft and crankshafts eccentrically provided in the rotary shaft, and compresses a refrigerant in the compression mechanism.

For example, Jpn Pat. Appln. KOKAI Publication No. 08-144976 (patent document 1) discloses a rotary compressor comprising a 2-cylinder compression mechanism, which is formed to accord with the following equation, assuming the inside diameter of the cylinder to be ϕDa, the height of the cylinder to be H, and the eccentricity of the crankshaft to be E.

$$H/(\phi Da \cdot E)=0.07-0.13$$

However, in this configuration, optimum balance between mechanical loss and leakage/heat receiving loss does not meet a conventional design value (0.07–0.13), and highest efficiency is difficult in the compression mechanism.

Jpn Pat. Appln. KOKAI Publication No. 2006-37893 (patent document 2) proposes technology to solve the above problem and realize highest efficiency. This patent application discloses a 2-cylinder rotary compressor, in which the cylinder is formed to accord with the following equation, assuming the inside diameter of the cylinder to be ϕDa, the height of the cylinder to be H, and the eccentricity of the crankshaft to be E.

$$0.05 \leqq H/(\phi Da \cdot E) < 0.07$$

It is known particularly in a rotary compressor that a crankshaft, and the ratio of the crankshaft diameter ϕDb to the sliding length L of a roller fitted in the crankshaft (L/ϕDb) have a large influence on a sliding loss in a compression mechanism. However, the above patent document 2 mentions nothing about the ratio (L/ϕb).

BRIEF SUMMARY OF THE INVENTION

The above rotary compressor has the following problems. Particularly, a leakage loss is maximum between a roller and a cylinder in a rotary compressor (Refrigeration Association Collection of Papers Vol. 10, No. 2 [1993] pp. 335-340, etc.). Therefore, the leakage loss can be decreased by reducing the cylinder height H. In this case, the cylinder inside diameter ϕDa or eccentricity E needs to be increased in order to ensure equivalent exclusion capacity.

In other words, the leakage loss is decreased and the compression efficiency is improved, if the ratio of the cylinder inside diameter ϕDa and eccentricity E [H/(ϕDa•E)] to the cylinder height H, or the value K, is set small. Particularly, when using a working fluid which is largely different in high and low pressures, the value K needs to be decreased furthermore.

There is Mckee's experimental formula as shown in FIG. 2 for obtaining the sliding loss of the crankshaft in the above rotary compressor, and the ratio of the crankshaft diameter ϕDb to the sliding length L of the roller fitted in the crankshaft (L/ϕDb). According to the drawing, it is obvious that when the L/ϕDb is small, the sliding loss of the crankshaft is largely increased.

According to the above relationship, it is necessary to decrease the value K and increase L/ϕDb for improving the performance. However, when the value K is decreased, the cylinder inside diameter ϕDa is limited by the outside diameter of a sealed case housing a rotary compressor, and cannot not be increased over a certain value.

It is necessary to relatively decrease the cylinder height H, and increase the eccentricity E. In this case, as H>L and ϕDb>countershaft:ϕDc+2E (for assembling a roller through a countershaft), L/ϕDb cannot be set large.

In other words, if L/ϕDb is forcibly increased, the countershaft diameter ϕDc must be extremely decreased, sacrificing the reliability. Therefore, it is necessary to recognize the presence of optimum balance between the value K [H/(ϕDa•E)] and L/ϕDb.

The present invention has been made in the above circumstances. It is an object of the invention to provide a high performance reliable rotary compressor, which confirms an optimum balance between a value K [H/(ϕDa•E)] and L/ϕDb, decreases the height of cylinder, decreases leakage loss and sliding loss, ensures exclusion capacity, and improves compression efficiency, and refrigeration cycle equipment, which uses the rotary compressor, and improves the efficiency of refrigeration cycle.

In order to achieve the above object, a rotary compressor according to the invention contains a motor unit and compression mechanism in a sealed case, transmits the rotational power of the motor to the compression mechanism through a rotary shaft and crankshafts eccentrically provided in the rotary shaft, and compresses a refrigerant in the compression mechanism, wherein the rotary compressor is configured to accord with the following equation, assuming that the inside diameter of the cylinder forming the compression mechanism is ϕDa [mm], the cylinder height is H [mm], the crankshaft eccentricity is E [mm], the crankshaft diameter is ϕDb [mm], and the sliding length of the crankshaft and the roller fitted in the crank is L [mm]:

$$H/(\phi Da \cdot E)=K$$

$$K \leqq 0.065, \text{ and}$$

$$0.35+0.07 \cdot K \cdot H \leqq L/\phi Db \leqq 0.45+0.07 \cdot K \cdot H$$

In order to achieve the above object, refrigeration cycle equipment according to the invention comprises the rotary compressor, a condenser, an expansion device, and an evaporator.

DETAILED DESCRIPTION OF THE INVENTION

Figure 1:
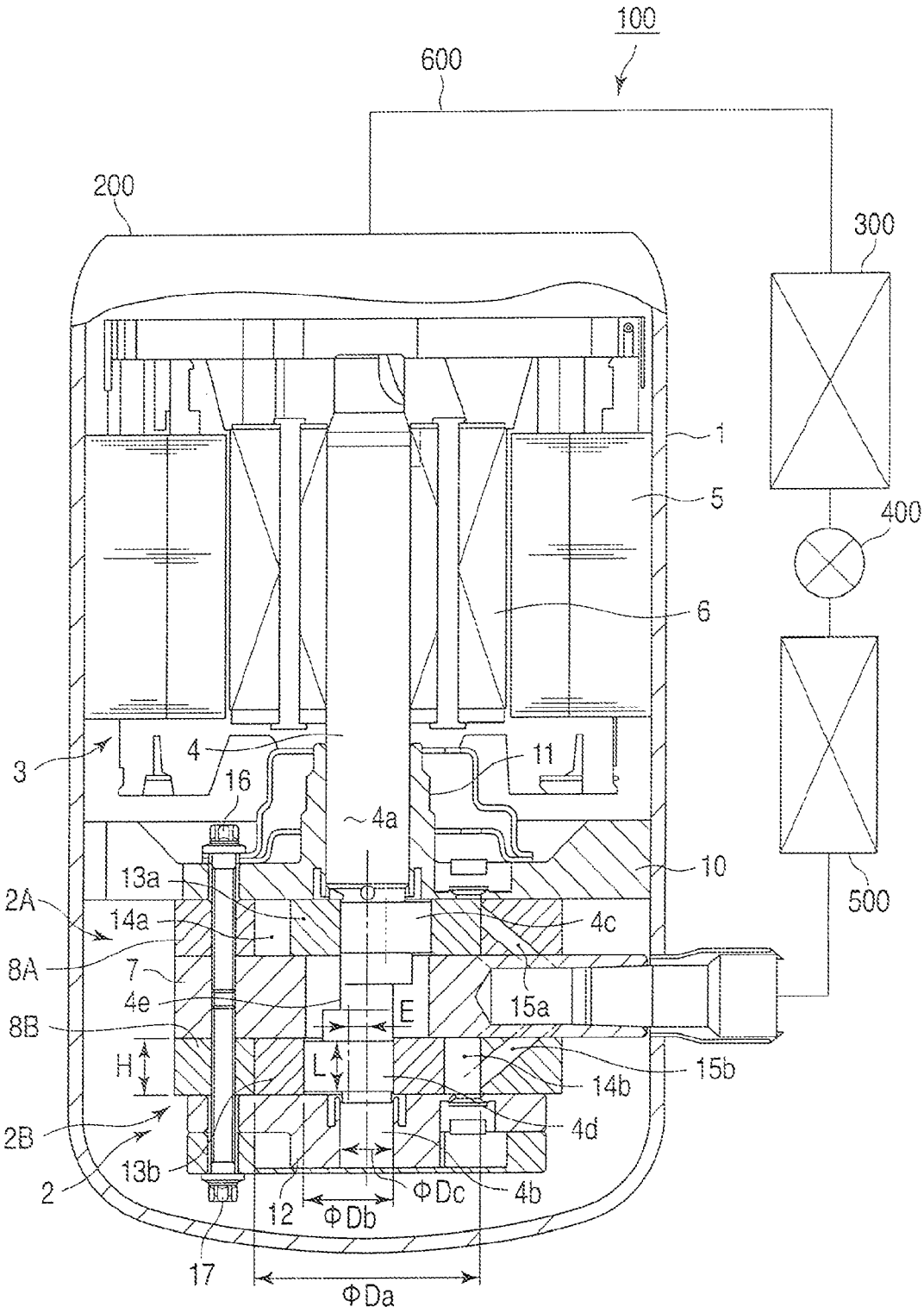
FIG. 1 shows a block diagram of a refrigeration cycle of refrigeration cycle equipment, and a longitudinal sectional view of a rotary compressor, according to an embodiment of the invention.
Figure 2:
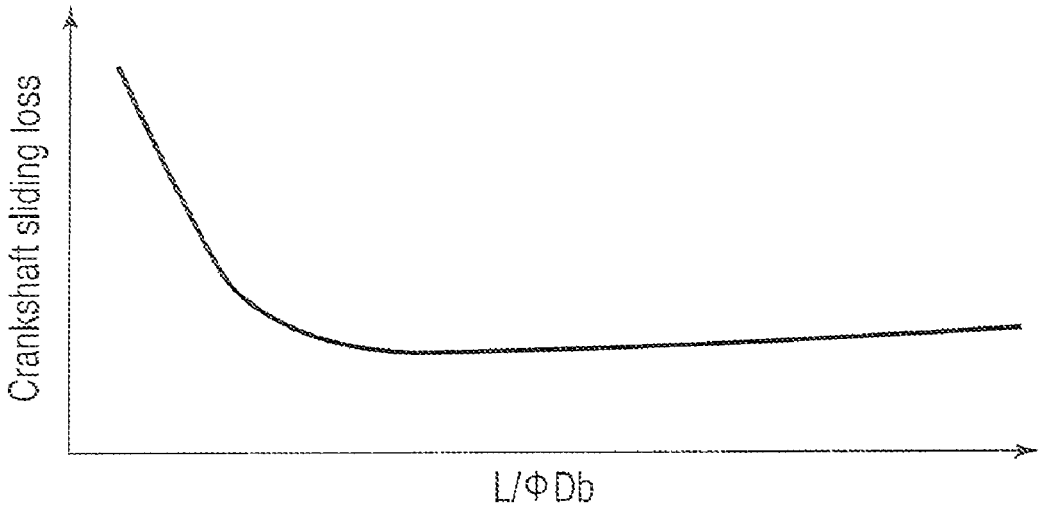
FIG. 2 is a graph showing a relationship between a sliding loss of a common crankshaft and L/ϕDb.

FIG. 1 shows a cross section structure of a rotary compressor 200, and a block diagram of refrigeration cycle equipment 100 comprising the rotary compressor 100. (To simplify the drawing, the parts, which are explained but not denoted by reference numbers, are not shown, or shown in the drawing but not denoted.)

First, the configuration of the refrigeration cycle equipment 100 will be explained. The refrigeration cycle equipment 100 comprises a rotary compressor 200, a condenser 300, an expansion device 400, an evaporator 500, and a not-shown gas-liquid separator. These components are sequentially communicated through a refrigerant pipe 600. As described later, refrigerant gas is compressed by the rotary compressor 200, discharged to the refrigerant pipe 600, circulated through the above components, forming a refrigerating cycle, and drawn into the rotary compressor 200.

Next, the rotary compressor 200 will be described in detail.

A reference number 1 in FIG. 1 denotes a sealed case. A compression mechanism 2 is provided in the lower part of the sealed case 1, and a motor unit 3 is provided in the upper part. The compression mechanism 2 and motor unit 3 are connected through a rotary shaft 4.

The motor unit 3 uses a brushless synchronous motor (an AC motor or commercial power motor), for example, and comprises a stator 5 which is press fitted in the sealed case 1, and a rotor 6 which is provided inside the stator 5 with a predetermined clearance, and fitted to the rotary shaft 4.

The compression mechanism 2 comprises a first compression mechanism 2A, and a second compression mechanism 2B. The first compression mechanism 2A is formed in the upper side, and comprises a first cylinder 8A. The second compression mechanism 2B is formed in the lower side through an intermediate partition plate 7 under the first cylinder 8A, and comprises a second cylinder 8B.

The first cylinder 8A is fixed to a frame 10 pressed fitted to the inner periphery of the sealed case 1, through a fixing bolt 16. A main bearing 11 is provided in a single piece with the shaft center of the frame 10, and stacked on the upper surface of the first cylinder 8A.

The first cylinder 8A and valve cover are fixed to the main bearing 11 through a fixing bolt 16. A sub-bearing 12 and valve cover are stacked on the lower surface of the second cylinder 8B, and fixed to an intermediate partition plate 7 through a fixing bolt 17.

The part pivotally fixed to the main bearing 11 is called a main shaft 4*a*, and the part pivotally fixed to the sub-bearing 12, the lower most end of the rotary shaft 4, is called a countershaft 4*b*. Crankshafts 4*c* and 4*d* are provided in one piece at the position penetrating the interior of the first and second cylinders 8A and 8B of the rotary shaft 4. A joint 4*e* opposing the intermediate partition plate 7 is provided between the crankshafts 4*c* and 4*d*.

The crankshafts 4*c* and 4*d* are formed with a phase difference of about 180°, displacing by the same distance from the center axis of the main shaft 4*a* and countershaft 4*b* of the rotary shaft 4, and having the same diameter. A first roller 13*a* is fitted over the crankshaft 4*c*, and a second roller 13*b* is fitted over the crankshaft 4*d*. The first and second rollers 13*a* and 13*b* are formed to have the same outside diameter.

The inside diameter parts of the first and second cylinders 8A and 8*b* are separated into upper and lower parts by the main bearing 11, intermediate partition plate 7, and sub-bearing 12. The first roller 13*a* is housed eccentrically rotatable in a first cylinder chamber 14*a* separated by the above members. The second roller 13*b* is housed eccentrically rotatable in a second cylinder chamber 14*b* separated by the above members.

The first and second rollers 13*a* and 13*b* are formed with a phase difference of 180°, but designed to have a part of the peripheral surface along the axial direction eccentrically rotatable while line contacting with the peripheral walls of the cylinder chambers 14*a* and 14*b*.

Blade chambers are provided in the first and second cylinders 8A and 8B. Each blade chamber contains a blade and a spring member. The spring member is a compression spring, which applies elastic force (back pressure) to the blade, and makes its distal end line contact along the axial direction of the peripheral surface of the rollers 13*a* and 13*b*. Therefore, the blade reciprocates along the blade chamber, and divides the cylinder chambers 14*a* and 14*b* into two compartments regardless of the rotational angles of the rollers 13*a* and 13*b*.

Discharge valve mechanisms are provided in the main bearing 11 and sub-bearing 12. Each discharge valve mechanism communicates with the cylinder chambers 14*a* and 14*b*, and is covered by a valve cover. As described later, the discharge valve mechanism is opened when the pressure of the refrigerant gas compressed in the cylinder chambers 14*a* and 14*b* is increased to a predetermined value. The compressed refrigerant gas is discharged from the cylinder chambers 14*a* and 14*b* into the valve cover, and led to the sealed case 1.

The thickness of the intermediate partition plate 7 inserted between the first and second cylinders 8A and 8B is made the same or larger than those of the cylinders 8A and 8B. A fixing hole is provided in the area from the outer peripheral wall of the intermediate partition plate 7 to the axial direction. The refrigerant pipe 600 is connected to the fixing hole through the evaporator 500, gas-liquid separator, and sealed case 1.

The intermediate partition plate 7 has suction holes 15*a* and 15*b*, which are provided obliquely upward and downward from the fixing hole connecting the refrigerant pipe 600. The suction hole 15*a* provided obliquely upward is opened in the inside diameter part of the first cylinder 8A, and the suction hole 15*b* provided obliquely downward is opened in the inside diameter part of the second cylinder 8B.

In other words, the suction hole 15*a* opened in the inside diameter part of the first cylinder 8A forms a suction part of the first cylinder chamber 14*a*, and the suction hole 15*b* opened in the inside diameter part of the second cylinder 8B forms a suction part of the second cylinder chamber 14*b*.

In the rotary compressor 200 configured as above, when the motor unit 3 is powered, the rotary shaft 4 is rotated, the first roller 13*a* is eccentrically moved in the first cylinder chamber 14*a*, and the second roller 13*b* is eccentrically moved in the second cylinder chamber 14*b*. The refrigerant gas separated by the gas-liquid separator is drawn into one of the chambers, which is separated by a blade in each cylinder chamber 14*a* and 14*b*, and the suction holes 15*a* and 15*b* are provided, through the suction refrigerant pipe 600.

As the crankshafts 4*c* and 4*d* fixed to the rotary shaft 4 are formed to have a phase difference of 180°, the same phase difference 180° occurs at the timing of drawing the refrigerant gas from the suction holes 15*a* and 15*b* into the cylinder chambers 14*a* and 14*b*. When the first and second rollers 13*a* and 13*b* are eccentrically moved, the capacity of the chamber close to the discharge valve mechanism is decreased, and the pressure is increased by the volume equivalent to the decreased capacity.

When the capacity of the chamber close to the discharge valve mechanism reaches a predetermined value, the refrigerant gas compressed in this chamber is increased to a predetermined pressure. At the same time, the discharge valve mechanism is opened, and the compressed high-temperature high-pressure refrigerant gas is discharged into the valve cover. A phase difference of 180° occurs at the timing of discharging the compressed refrigerant gas to the discharge valve mechanism.

The compressed refrigerant gas is directly or indirectly led to the space between the compression mechanism 2 and motor unit 3 in the sealed case 1. The compressed refrigerant gas is passed through the clearance between the rotary shaft 4 and rotor 6 forming the motor unit 3, between the rotor and stator 5, and between the stator and the inner peripheral wall of the sealed case 1, and is filled in the space in the sealed case 1 formed above the motor unit 3.

The compressed refrigerant gas is sent from the rotary compressor 200 to the refrigerant pipe 600, led to the condenser 300 and condensed, and led to the expansion device 400 and adiabatically expanded, and led to the evaporator and evaporated, drawing heat from the surrounding area, providing refrigerating effect. The evaporated refrigerant is led to the gas-liquid separator and separated into gas and liquid, and only the gas component is drawn into the compression mechanism 2 of the rotary compressor 200, and compressed again.

As described above, the rotary compressor 200 is desirably decreased in the diameter of the crankshafts 4*c* and 4*d*, which is the largest in the sliding part of the rotary shaft 4, in order to decrease the friction loss and increase the compression efficiency. At the same time, it is desirable to decrease the height (thickness) of the first and second cylinders 8A and 8B, increase the eccentricity, and decrease the sliding loss of the rotary shaft 4.

Therefore, the inside diameters and heights of the first and second cylinders 8A and 8B, the eccentricity and diameters of two crankshafts 4*c* and 4*d*, and the sliding lengths of the crankshafts 4*c* and 4*d* and the rollers 13*a* and 13*b*, are set as follows in this embodiment.

Namely, the inside diameters of the first cylinder 8A forming the first compression mechanism 2A and second cylinder 8B forming the second compression 2B are set to ϕDa [mm]. The heights of the first and second cylinders 8A and 8B are set to H [mm]. The eccentricity of the crankshafts 4*c* and 4*d* with respect to the shaft center of the rotary shaft 4*c* is set to E [mm]. The diameters of the crankshafts 4*c* and 4*d* are set to ϕDb [mm]. The sliding lengths (the contact length in the axial direction) of the crankshafts 4*c* and 4*d* and the first and second rollers 13*c* and 13*d* fitted over the crankshafts are set to L [mm].

The compressor is configured to accord with H/(ϕDa•E) =K, and K≦0.065, in this state, and the following equation is established.

$$H/(\phi Da \cdot E)=K$$

$$K \leqq 0.065, \text{ and}$$

$$0.35+0.07 \cdot K \cdot H \leqq L/\phi Db \leqq 0.45+0.07 \cdot K \cdot H$$

Figure 3:
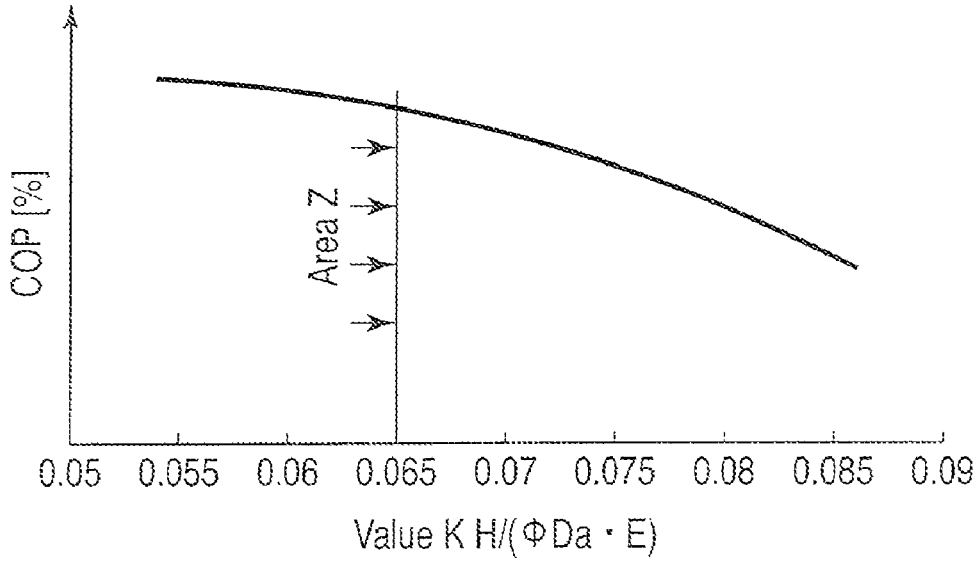
FIG. 3 is a graph showing a relationship between a value K and COP in the above embodiment.

FIG. 3 shows an example of a relationship between the value K (H/(ϕDa•E) and coefficient of performance (COP), when the condition of L/ϕDb and the exclusion capacity in each cylinder chamber 14*a* and 14*b* are constant. As shown in the area Z in this drawing, COP can be kept high by setting K≦0.065.

Figure 4:
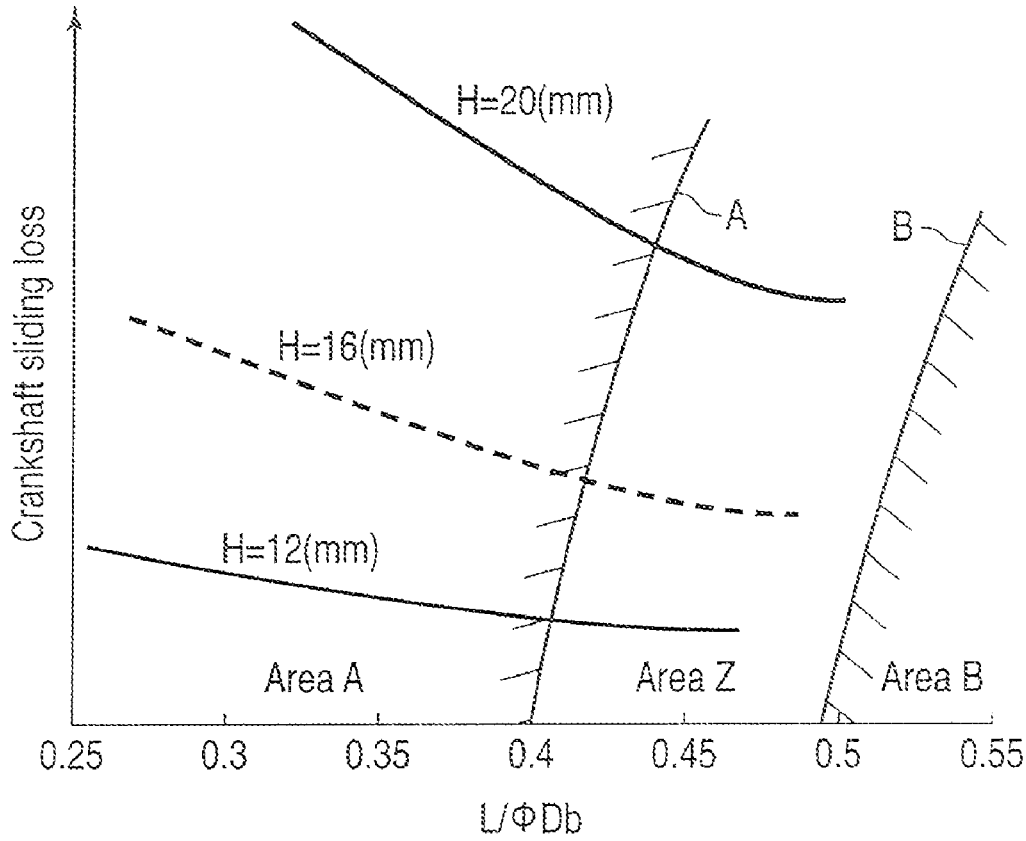
FIG. 4 is a graph showing an example of calculation of the relationship between L/ϕDb and crankshaft sliding loss in first and second cylinder heights.

FIG. 4 shows an example of calculation of the relationship between L/ϕDb and sliding loss of crank shafts 4*c* and 4*d*, in three types of rotary compressor 200, in which K=0.064, and the cylinder height H=12, 16, and 20 mm.

In particular, the line A indicates L/ϕDb=0.35+0.07•K•H (K=0.064), and the line B indicates L/ϕDb=0.45+0.07•K•H (K=0.064). (Gas load W and crank receiving pressure projection area L×ϕDb are assumed to be the same for each cylinder height H.)

In the area (A) of L/ϕDb>0.35+0.07•K•H in FIG. 4, the sliding loss of the crankshafts 4*c* and 4*d* is greatly increased. In the area (B) of L/ϕDb>0.45+0.07•K•H in FIG. 4, the diameter of the countershaft 4*b* is extremely decreased, and design ensuring reliability is impossible.

Therefore, as described above, the leakage loss and sliding loss are prevented by making the condition, in which the following formula is established, that is, the area Z, and the reliability and high performance of the rotary compressor 200 can be ensured.

$$0.35+0.07 \cdot K \cdot H \leqq L/\phi Db \leqq 0.45+0.07 \cdot K \cdot H$$

The refrigeration cycle efficiency can be improved by using the above rotary compressor 200 in the refrigeration cycle equipment 100.

Table 1 shows an example of a known conventional rotary compressor for an air-conditioning and refrigeration water heater. The example does not simultaneously satisfy the value K [H/(ϕDa•E)] and L/ϕDb of the invention. This is resulted from that the range satisfying the invention is limited and narrow, and the influence of L/ϕDb of the crankshafts 4*c* and 4*d* is practically unconsidered.

TABLE 1

| Cylinder height H [mm] | Cylinder diameter $\phi D_a$ [mm] | Eccentricity E [mm] | Crankshaft sliding length L [mm] | Crankshaft diameter $\phi D_b$ | Counter-shaft diameter $\phi D_c$ | $\frac{H}{\phi D_a \cdot E}$ | $\frac{L}{\phi D_b}$ |
|---|---|---|---|---|---|---|---|
| 10 | 60 | 3.15 | 8 | 22.5 | 16 | 0.053 | 0.36 |
| 11.5 | 44 | 3.8 | 9 | 24 | 16 | 0.069 | 0.38 |
| 16 | 43 | 4.6 | 9 | 26 | 16 | 0.081 | 0.35 |
| 22 | 63 | 5.3 | 16 | 37.5 | 25 | 0.066 | 0.43 |

Table 2 shows an example of design based on this embodiment. The design prevents the crank sliding loss, and increases the performance and reliability.

TABLE 2

| Cylinder height H [mm] | Cylinder diameter $\phi D_a$ [mm] | Eccentricity E [mm] | Crankshaft sliding length L [mm] | Crankshaft diameter $\phi D_b$ | Counter-shaft diameter $\phi D_c$ | $\frac{H}{\phi D_a \cdot E}$ | $\frac{L}{\phi D_b}$ |
|---|---|---|---|---|---|---|---|
| 12 | 43 | 4.4 | 9 | 21.4 | 12.5 | 0.063 | 0.42 |
| 16 | 50 | 5 | 13 | 28.6 | 18.5 | 0.064 | 0.45 |
| 20 | 60 | 5.4 | 17 | 35.9 | 25 | 0.062 | 0.47 |

The rotary compressor 200 is a so-called multi-cylinder type comprising first and second cylinders 8A and 8B. The rotary compressor is not limited to this type. The invention may be applied to a rotary compressor comprising one cylinder.

The invention is not limited to the embodiment described above. The invention may be embodied by modifying the constituent elements in practical phases without departing from its spirit and essential characteristics. The invention may be embodied in various forms by appropriately combining two or more constituent elements disclosed in the embodiment described hereinbefore.

According to the invention, leakage loss and sliding loss can be decreased, and efficiency in compression and refrigeration cycle can be improved.

What is claimed is:

1. A rotary compressor, which contains a motor unit and a compression mechanism in a sealed case, transmits the rotational power of the motor to the compression mechanism through a rotary shaft and crankshafts eccentrically provided in the rotary shaft, and compresses a refrigerant in the compression mechanism, wherein the rotary compressor is configured to accord with the following equations, assuming that an inside diameter of the cylinder forming the compression mechanism is ϕDa [mm], a cylinder height is H [mm], a crankshaft eccentricity is E [mm], a crankshaft diameter is ϕDb [mm], and a sliding lengths of the crankshaft and a roller fitted over the crankshaft set to L [mm]:

$$H/(\phi Da \cdot E)=K$$

$$K \leqq 0.065, \text{ and}$$

$$0.35+0.07 \cdot K \cdot H \leqq L/\phi Db \leqq 0.45+0.07 \cdot K \cdot H.$$

2. Refrigeration cycle equipment comprising the rotary compressor according to claim 1, a condenser, an expansion device, and an evaporator.

* * * * *